US011066713B2

(12) United States Patent
Francis et al.

(10) Patent No.: US 11,066,713 B2
(45) Date of Patent: Jul. 20, 2021

(54) METHOD OF OPERATING A TOP SUBMERGED LANCE FURNACE

(71) Applicant: Tenova South Africa (Pty) Ltd, Johannesburg (ZA)

(72) Inventors: Brett John Francis, Paddington (AU); Hugo Joubert, The Gap (AU); Martin Lluis Bakker, Upper Kedron (AU); Stanko Nikolic, Fig Tree Pocket (AU); Stephen Gwynn-Jones, Nundah (AU)

(73) Assignee: Tenova South Africa (Pty) Ltd, Johannesburg (ZA)

( * ) Notice: Subject to any disclaimer, the term of this patent is extended or adjusted under 35 U.S.C. 154(b) by 176 days.

(21) Appl. No.: 16/060,632

(22) PCT Filed: Dec. 9, 2016

(86) PCT No.: PCT/IB2016/057462
§ 371 (c)(1),
(2) Date: Jun. 8, 2018

(87) PCT Pub. No.: WO2017/098446
PCT Pub. Date: Jun. 15, 2017

(65) Prior Publication Data

US 2019/0010563 A1 Jan. 10, 2019

(30) Foreign Application Priority Data

Dec. 9, 2015 (ZA) ..... 2015/08993

(51) Int. Cl.
*C21C 5/46* (2006.01)
*F27B 3/22* (2006.01)
(Continued)

(52) U.S. Cl.
CPC ..... *C21C 5/462* (2013.01); *C21C 5/4613* (2013.01); *F27B 3/22* (2013.01); *F27D 3/0026* (2013.01); *F27D 3/0033* (2013.01); *F27D 3/18* (2013.01)

(58) Field of Classification Search
CPC ..... C21C 5/4613; C21C 5/462; F27B 3/22; F27D 3/0026; F27D 3/0033; F27D 3/18
(Continued)

(56) References Cited

U.S. PATENT DOCUMENTS 4,097,031 A * 6/1978 Higuchi ..... C21C 5/4606 266/226
4,141,249 A 2/1979 Ishikawa et al.
(Continued)

FOREIGN PATENT DOCUMENTS

CN 103620333 A 3/2014
CN 103797137 A 5/2014
(Continued)

OTHER PUBLICATIONS

Search Report for Chinese Application No. 201680070170.4, Chinese Patent Office, dated Mar. 27, 2019, 2 pages.
(Continued)

*Primary Examiner* — Scott R Kastler
*Assistant Examiner* — Michael Aboagye
(74) *Attorney, Agent, or Firm* — Sterne, Kessler, Goldstein & Fox P.L.L.C.

(57) ABSTRACT

A method of operating a top submerged lance furnace, and more particularly but not exclusively to a method of coating an end of a lance of a top submerged lance furnace with a slag layer, as well as a method of maintaining a uniform heat distribution about the periphery of the lance of the top submerged lance furnace. In terms of the method, the lance is caused to rotate, and a fluid is passed through the lance
(Continued)

before it is inserted into the molten material bath inside the crucible.

6 Claims, 5 Drawing Sheets

(51) Int. Cl.
*F27D 3/00* (2006.01)
*F27D 3/18* (2006.01)

(58) Field of Classification Search
USPC .... 266/44, 225, 226, 217, 235; 75/651, 629, 75/640, 655, 691, 695
See application file for complete search history.

(56) References Cited

U.S. PATENT DOCUMENTS 4,251,271 A * 2/1981 Floyd ..... C21C 5/4613 266/225
4,426,068 A * 1/1984 Gimond ..... C22B 21/066 266/217
7,563,405 B2 * 7/2009 De Castro ..... C21C 5/4606 266/225
2009/0071294 A1 3/2009 Schmeisser
2014/0263703 A1 9/2014 Waitlevertch et al.

FOREIGN PATENT DOCUMENTS

CN 105121670 A 12/2015
GB 2 045 928 A 11/1980
JP 401073014 * 3/1989 ..... C21C 5/4606
JP 2009091617 * 4/2009 ..... C21C 5/462
WO WO 99/34024 A1 7/1999
WO WO 2006/021066 A1 3/2006
WO 2015056143 A1 4/2015

OTHER PUBLICATIONS

Office Action for Chinese Application No. 201680070170.4, Chinese Patent Office, dated Apr. 4, 2019, 15 pages.
C. B. Solnordal, F. R. A. Jorgensen, and R. N. Taylor, "Modeling the Heat Flow to an Operating Sirosmelt Lance," Metall. Mater. Trans. B, 1998, vol. 29B, pp. 485-492, 8 pages.
S. Gwynn-Jones, K. Hooman, and B. Daniel, "Thermal Bending of Air Cooled Tubes," International Workshop on Thermal Forming and Welding Distortion, Bremen, Apr. 9-10, 2014, 20 pages.

* cited by examiner

METHOD OF OPERATING A TOP SUBMERGED LANCE FURNACE

BACKGROUND TO THE INVENTION

THIS invention relates to a method of operating a top submerged lance furnace, and more particularly but not exclusively to a method of coating an end of a lance of a top submerged lance furnace with a slag layer, as well as a method of maintaining a uniform heat distribution about the periphery of the lance of the top submerged lance furnace. The invention also relates to a top submerged lance furnace suitable for use in giving effect to this method.

A top submerged lance furnace is a type of furnace used in pyrometallurgy, and in particular in the smelting of minerals, metals and metallurgical ore. A top submerged lance furnace comprises a crucible for receiving and containing liquid metal, speiss, matte and/or a slag bath. The crucible is typically in the form of an upright-cylindrical shaped vessel that is lined with a containment lining, i.e. refractory bricks or copper coolers. A freeboard extension is provided above the furnace crucible, and an operatively upper zone of the furnace vessel, and hence an operatively upper zone of the freeboard, usually flares out in one radially outwardly direction towards a gas take-off.

A vertically orientated, suspended steel lance extends through the roof of the furnace into the crucible through a hole in the roof of the furnace. An end of the lance is, in use, submerged below the surface of the liquid bath located in the crucible. Any one or more of process air, oxygen-enriched air, nitrogen-enriched air, oxygen, fuel, flux, reductant and feed material are injected into the bath via the lance. The feed material, e.g. mineral concentrates or materials for recycling, reductant, flux and solid fuel can also be dropped into the bath through another hole in the furnace roof. The lance will, however, always introduce at least the process air f oxygen-enriched air f nitrogen-enriched air into the molten bath, resulting in vigorous agitation of the bath. The feed materials also react with either an oxygen deficiency in the bath or an oxygen excess in the bath, delivered by the injected gas and or feed materials, resulting in an intensive reaction in a small volume.

The lance is configured to be able to move up and down relative to the crucible, and hence the molten bath, and this is typically achieved by the lance being supported by a displaceable carriage. The displaceable carriage is located outboard of the crucible or furnace vessel, and can be moved up and down in order to control the penetration depth of the lance into the molten bath.

U.S. Pat. No. 4,251,271 discloses a top submerged lance furnace, and in particular a method of injecting gas into a liquid pyro-metallurgical bath of a top submerged lance furnace. In accordance with this method, the gas is injected through a lance having an interior duct through which the gas flows. The gas is discharged from the lance from a discharge end, at which point the gas is discharged into the molten bath. The method includes the specific steps of presenting the discharge end of the lance to the molten mass of slag prior to the lance being submerged into the molten bath, and forcing gas through the lance to splash-coat the discharge end of the lance with molten slag. The coated lance tip is subsequently inserted into the molten bath. This layer of coating or solid slag protects the lance tip from the high temperatures inside the furnace. The tip of the lance that is submerged in the bath eventually wears out, and the worn lance is easily replaced with a new one when necessary. The worn tips are subsequently cut off and a new tip welded onto the lance body before it is returned to the furnace.

U.S. Pat. No. 4,251,271 also discloses a gas flow swirler means inside the lance, which imparts a swirling action onto the gas flowing through the lance. The purpose of the flow swirler means is to cause the injected gas to spin within the lance, forcing it against the lance wall, thus cooling the lance wall. The cooling effect aids in the solidification of the coating layer, and in effect results in the layer of slag "freezing" on the outside of the lance.

Other examples exist where a lance of a top submerged lance furnace is inserted into a liquid bath of the furnace without a specific step of forming of a coating layer on the lance.

A top submerged lance furnace typically operates in the range of 800 to 1600° C., depending on the application. The containment lining, i.e. refractory bricks and/or copper coolers that forms the internal lining of the furnace, protects the steel shell or steel support structure from the heat inside the crucible or furnace. The products are removed from the furnace through one or more tap holes, openings or weirs in a process called tapping. This can be either continuous removal or batch removal.

A problem associated with existing top submerged lance furnaces is that the injection lance tends to bend due to differential heating along its length and around its circumference during operation. Bending is a consequence of local plastic deformation caused by thermal stresses induced by the differential heating. The differential heating is in turn caused by varying thermal conditions in different parts of the furnace, as well as the inconsistent formation and/or thickness of the protective frozen slag layer or coating formed on the external surface along the length, and around the circumference, of the lance. It should be kept in mind that this protective coating is formed by a process of random splashing, and not in a controlled coating process.

Solnordal et al[1] determined that for operating top submerged lances in the region where the lance is coated by the slag, the heat transfer is a combination of multiphase convection and conduction. They suggested that the amount of heat transferred through to the inner lance pipe is related to the slag layer thickness with the following equation:

$$dQ = 2\pi \frac{k_s(T_{Furnace} - T_{Lance\ outer\ wall})}{\ln\left(\frac{r_{sing}}{r_{lance}}\right)} dx$$

where dQ—heat flow through a lance section $k_s$—thermal conductivity

T—Temperature r—Radius

Due to the chaotic nature of the splash that is present in the top submerged lance process, achieving uniform slag layers on the lance, and therefore uniform temperature distributions around the lance body circumferentially, is not possible.

Published works on the thermal bending of air cooled tubes, for example Gwynn-Jones et al[2], identified that cylindrical metal tubes used in high temperature industrial processes can be permanently bent out of shape when there is an adverse thermal gradient. The authors tested this experimentally by covering standard pipe sections with different amounts of insulation and cooling the pipe sections with a stream of air down the middle. The results indicated that the pipes would bend in different directions depending on the coverage of the insulation layer. The insulation layer is analogous to a slag layer and therefore this mechanism would hold for top submerged lance furnace lances exposed to furnace conditions with irregular slag layers.

On industrial operations, once a lance is bent beyond a certain point it is replaced as it has a reduced efficiency in mixing the bath which is essential for proper operation of the top submerged lance furnace. It may also become too difficult to insert and remove the lance through the insertion point in the roof of the furnace. Furnace operations are stopped as the lance is removed for repair. In addition excessive lance bending could potentially impact the sidewall refractory life of the top submerged lance reactor as noted in "*Treatise on Process Metallurgy, Volume* 3*: Industrial Processes*" by Seshadri Seetharaman. Refractory wear is the leading cause of plant downtime and one of the most significant maintenance costs.

In the other examples which were listed above where a lance of a top submerged lance furnace is inserted into a liquid bath of the furnace without a specific step of forming of a coating layer on the lance. These arrangements also suffer the common disadvantage of uneven heating of the lance, which in turn results in excessive bending of the lance during operation of the furnace.

It is accordingly an object of the invention to provide a method of operating a top submerged lance furnace that will, at least partially, alleviate the above disadvantages.

It is also the object of this invention to provide a method of operating a top submerged lance furnace which will improve the delivery efficiency of any one or more of process air, oxygen-enriched air, nitrogen-enriched air, oxygen, fuel, flux, reductant and feed material into the bath.

It is also an object of the invention to provide a method of operating a top submerged lance furnace which will be a useful alternative to existing methods.

It is also an object of the invention to provide a top submerged lance furnace that will, at least partially, alleviate the above disadvantages.

It is a still further object of the invention to provide a top submerged lance furnace which will be a useful alternative to existing top submerged lance furnaces.

SUMMARY OF THE INVENTION

According to the invention there is provided a method of operating a top submerged lance furnace, the method including the steps of:

- providing a lance having an internal flow passage provided therethrough, with an end of the lance located inside a crucible of a top submerged lance furnace,
- causing the lance to rotate;
- passing a fluid through the lance in order for the fluid to be discharged from an end of the lance; and
- submerging the end of the lance into a molten material bath inside the crucible.

The method may include the steps of:

- displacing the lance to a preparatory position in which the end of the lance is located above an upper surface of the molten material bath in order for the fluid being discharged from the end of the lance to impinge on the upper surface of the molten material bath, thereby causing at least some operatively upwardly splashing of molten material; and
- holding the lance in the preparatory position in order for splashes of the molten material to be deposited onto an outer wall of the lance during the rotation.

There is provided for the method to include the step of forming a protective coating about a circumference of the lance, the step being characterized in that molten material is deposited evenly about a circumference of the lance due to the lance being rotated.

There is provided for the method to include the step of imparting a swirling motion on the fluid passing through the lance in order for the fluid to be urged into contact with an inner surface of a sidewall of the lance, so as to result in the fluid cooling the sidewall of the lance There is provided for the lance to be rotated at a speed of between 0.1 and 120 rpm, preferably between 0.5 and 6 rpm, most preferably between 1 and 3 rpm.

There is provided for the lance to be rotated continuously or intermittently in one direction.

Alternatively, there is provided for the lance to be rotated continuously or intermittently in a first direction, and then subsequently for the lance to be rotated continuously or intermittently in a second, opposing direction.

Preferably, the lance will be rotated continuously in one direction.

There is provided for the fluid to include at least oxygen, process air, oxygenated air or nitrogenated air.

According to a further aspect of the invention there is provided a top submerged lance furnace including:

- a crucible suitable for holding a molten material bath;
- a roof in use covering an open end of the crucible;
- a lance, suitable for injecting a fluid into the molten material bath, extending through the roof into the crucible;
- characterized in that the lance is rotatable relative to the crucible.

The lance may be rotated by a drive arrangement.

The drive arrangement may include any one of a slew drive, a slew bearing with a separate drive, a motorized swivel joint, a swivel joint with a separate drive, a sleeve or bush arrangement with a separate drive rotating the lance, or any similar or suitable drive configuration.

There is provided for the lance to include a flow swirl inducing device provided in the flow passage in order to cause the fluid passing through the lance to swirl and to be urged into contact with an inner surface of a sidewall of the lance, so as to result in the fluid cooling the sidewall of the lance.

BRIEF DESCRIPTION OF THE DRAWINGS

An embodiment of the invention is described by way of a non-limiting example, and with reference to the accompanying drawings in which.

DETAILED DESCRIPTION OF INVENTION

Figure 1:
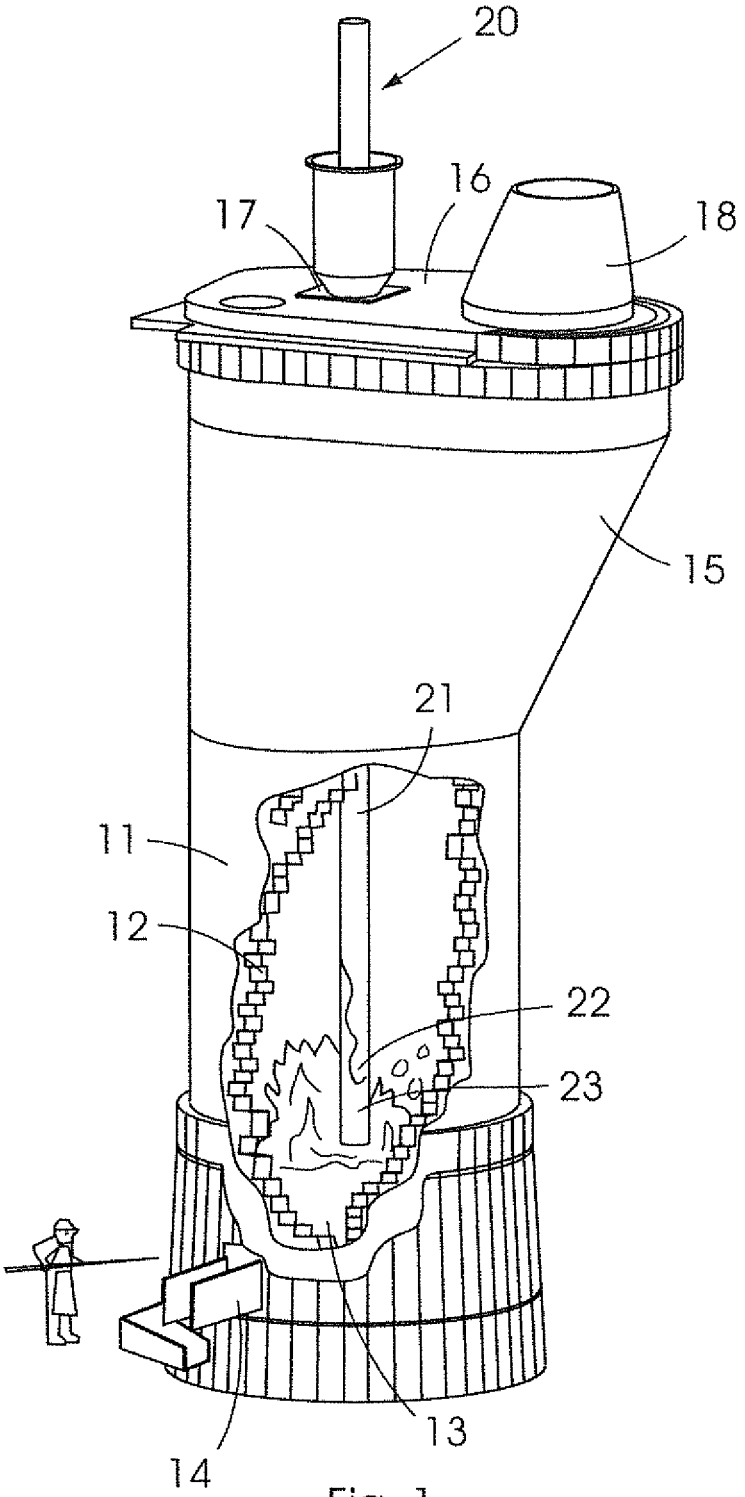
FIG. 1 is a schematic perspective view of a top submerged lance furnace as is known in the art.
Figure 2:
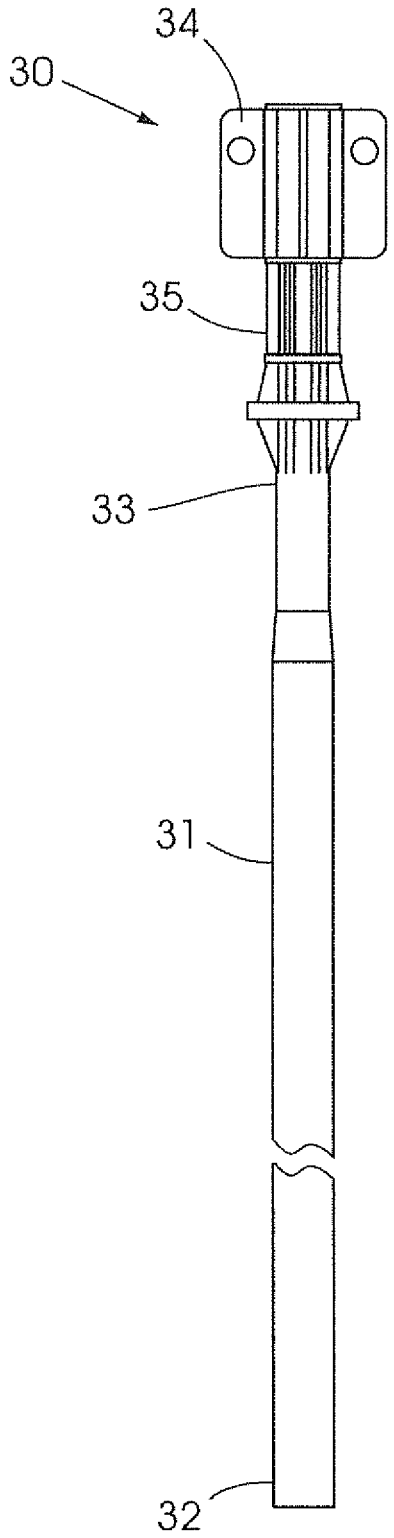
FIG. 2 is a front view of a lance arrangement of the top submerged lance furnace in accordance with the invention.
Figure 3:
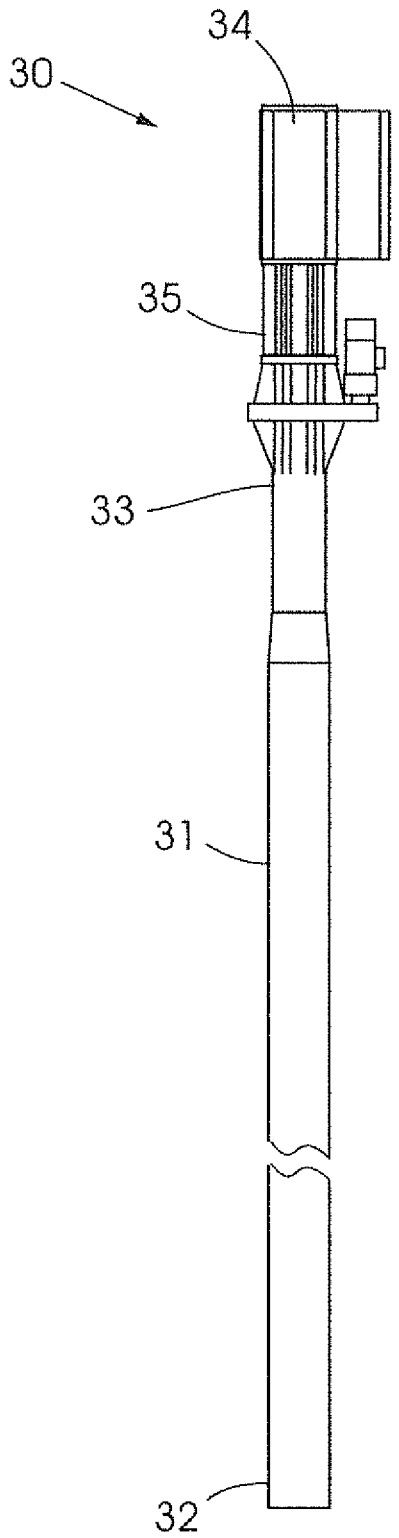
FIG. 3 is a side view of the lance arrangement of FIG. 2.
Figure 4:
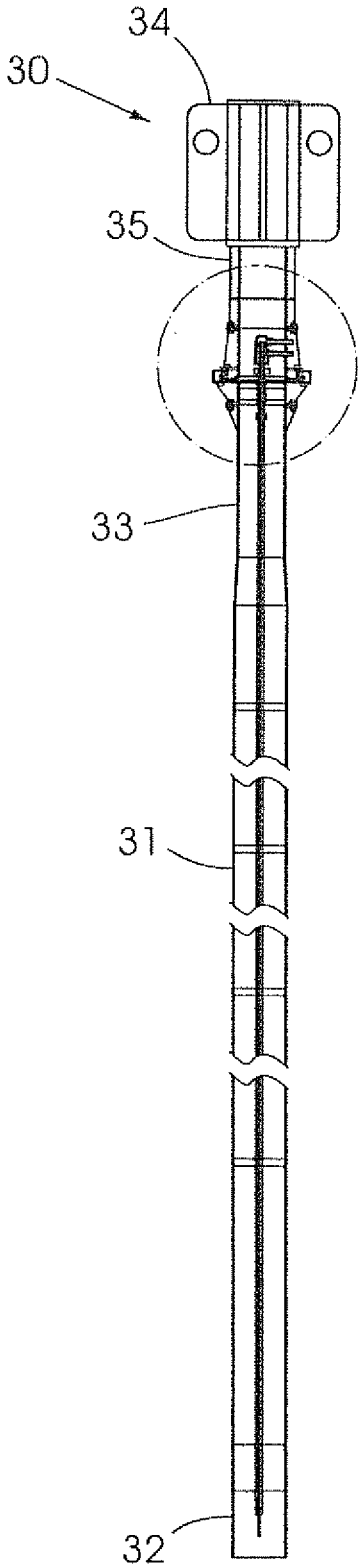
FIG. 4 is a cross-sectional front view of a lance arrangement of the top submerged lance furnace in accordance with the invention.
Figure 6:
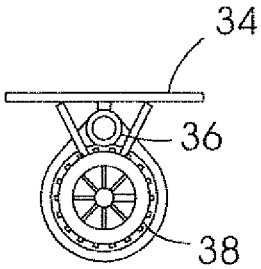
FIG. 6 is a top plan view of the lance arrangement of FIG. 2.
Figure 5:
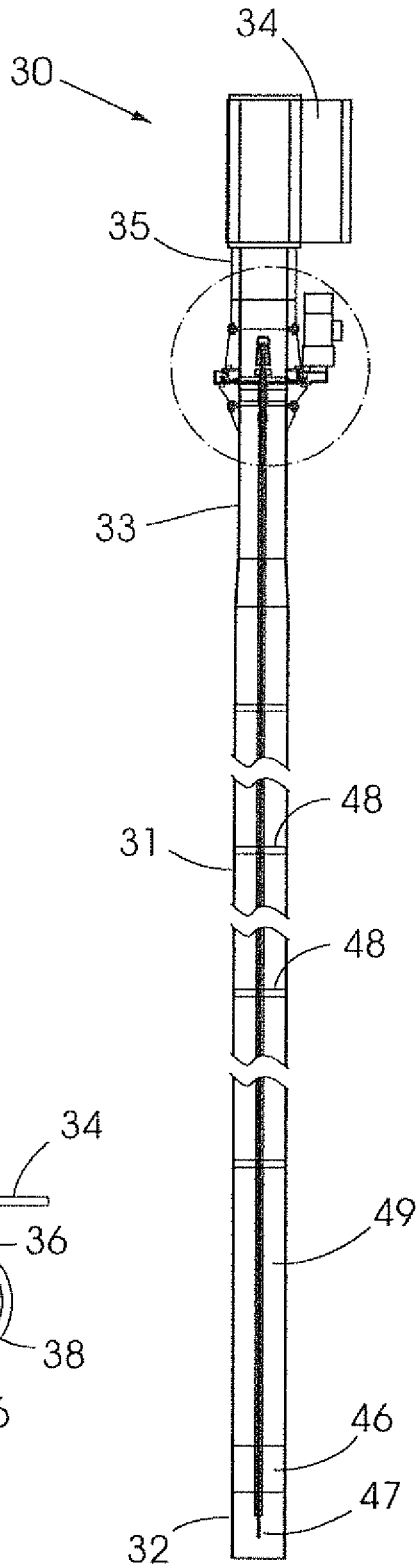
FIG. 5 is a cross-sectional side view of the lance arrangement of FIG. 4.
Figure 7:
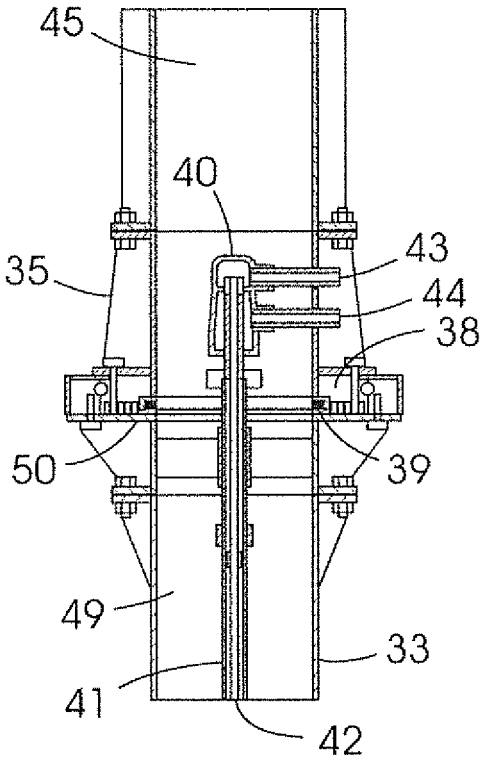
FIG. 7 is an enlarged view of part of the lance arrangement of FIG. 4.
Figure 8:
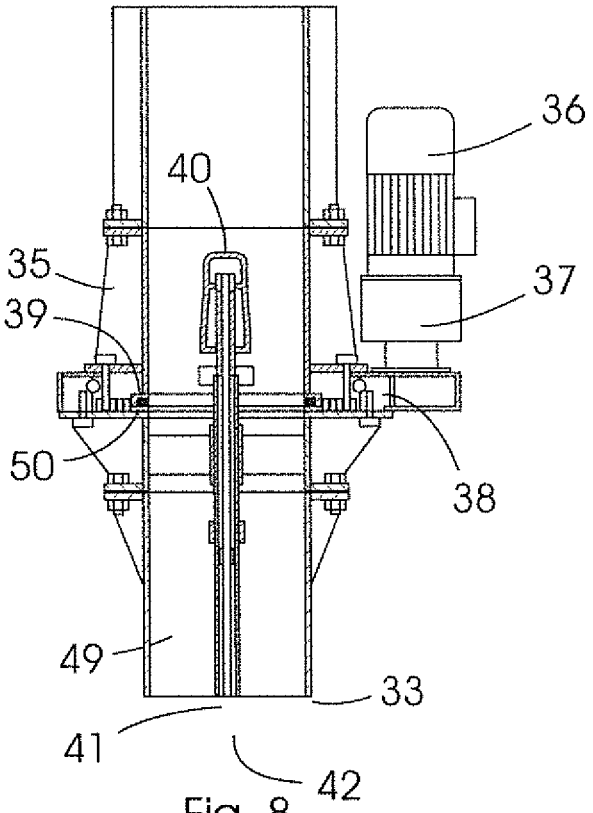
FIG. 8 is an enlarged view of part of the lance arrangement of FIG. 5.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings and are thus intended to include direct connections between two members without any other members interposed therebetween and indirect connections between members in which one or more other members are interposed therebetween. Further, "connected" and "coupled" are not restricted to physical or mechanical connections or couplings. Additionally, the words "lower", "upper", "upward", "down" and "downward" designate directions in the drawings to which reference is made. The terminology includes the words specifically mentioned above, derivatives thereof, and words or similar import. It is noted that, as used in this specification and the appended claims, the singular forms "a," "an," and "the," and any singular use of any word, include plural referents unless expressly and unequivocally limited to one referent. As used herein, the term "include" and its grammatical variants are intended to be non-limiting, such that recitation of items in a list is not to the exclusion of other like items that can be substituted or added to the listed items.

Referring to the drawings, in which like numerals indicate like features, a non-limiting example of a top submerged lance furnace in accordance with the invention is generally indicated by reference numeral 10.

A typical top submerged lance furnace is shown in FIG. 1, and comprises a primary furnace vessel 11, which is typically in the form of an upright cylindrical structure of which an inner wall is lined with a containment lining, for example refractory bricks 12. A crucible 13 is defined in the bottom of the vessel 11, and in use holds a molten bath of metal, speiss, matte, ore or slag. The molten product can be removed via a tap hole 14. An operatively upper end of the vessel terminates in an inversely conically flared section 15. A roof 16 covers an open end of the vessel 11, with a gas outlet port 16 allowing off gas to escape from the vessel 11 via the flared section 15.

A lance arrangement 20 extends into the vessel 11 through a lance opening 17. The lance arrangement includes a tubular lance 21 through which air, nitrogen and oxygen, and sometimes also fuel and feed material, are introduced into the molten metal bath. In order to achieve this, an operatively lower end 22 of the lance in use protrudes into the molten bath, with an outlet tip of the lance therefore being submerged below the surface of the molten bath. As has been described in more detail above, a solidified slag coating layer 23 is formed on the end of the lance 21 in order to protect the lance against the harsh conditions inside the furnace, and in particular the high temperature of the molten bath. The lance arrangement includes a carrier arrangement (not shown) which is vertically displaceable, and which therefore enables the concomitant vertical displacement of the lance 21.

The top submerged lance furnace in accordance with this invention is similar to the furnace shown in FIG. 1, with the major difference being the fact that the lance is rotatable. The lance will still be vertically displaceable like the prior art lance of FIG. 1, but will in addition to that also be rotatable relative to the furnace, and therefore relative to the molten bath.

Many different configurations and designs can be utilized to construct a rotating lance arrangement, and a single, non-limiting example of one such lance arrangement 30 is described with reference to FIGS. 2 to 8.

The lance arrangement 30 includes an elongate, tubular lance 31 that in use extends into the crucible of the furnace. The lance 31 has an operatively bottom end 32 that terminates in a tip formation through which the fluid conveyed by the lance is expelled, and discharged into the molten bath. An opposing, operatively upper end 33 of the lance is rotatably connected to an outer, stationary lance section 35. The lance 31 is rotatable relative to the stationary lance section 35, but both the lance 31 and the stationary lance section 35 can also be vertically displaced as a single unit by way of a carriage (not shown). The lance arrangement 30 is secured to such carriage by way of a connecting plate 34 or other means.

A drive arrangement is used to rotate the lance 31 relative to the stationary section 35, and in this embodiment includes an electrical drive 36 that drives a slew bearing 38 via a gearbox 37. The slew bearing 38 in turn rotates an end plate 50 of the lance 31, resulting in the rotation of the lance 31 relative to the stationary section 35. A rotary seal 39 creates a seal between the lance 31 and the stationary section 35. Process gas, oxygen, oxygenated air or nitrogenated air is introduced into the lance via open end 45, and passes through the lance 31 until it is discharged at the open end 32 of the lance.

The lance 31 is hollow, and in this embodiment two further conduits are provided inside the bore of the hollow lance 31. An outer tube 41 is located inside the lance 31, and is supported relative to the lance 31 by way of annular spacers 48. A gas flow annulus 49 is formed between the outer surface of the outer tube 41 and the inner surface of the tubular lance 31. A swirl inducing device 46, for example in the form of a helical baffle or angular blades, are provided towards the end of the lance 31, and imparts a swirling or spinning action to the gas flowing through the passage 49, thus forcing the gas into contact with an inner surface of the lance 31 so as to at least partially cool the inner surface of the gas by way of convective cooling.

An inner tube 42 is located inside the outer tube 41, and an annular passage is defined between the outer surface of the inner tube 42 and the inner surface of the outer tube 41. This annular passage brings a bottom zone of the lance 31 in flow communication with an operatively upper port 44, and can be used to measure the pressure at the discharge tip of the lance 31. The inner tube 42 furthermore forms a conduit for use in supplying fuel to the molten bath, and terminates in a fuel nozzle 47. An upper end 43 of the inner tube 42 is in flow communication with a fuel source (not shown). A rotary union 40 is provided at the upper ends of the outer tube 41 and the inner tube 42, and allows the tubes to rotate whilst still remaining in flow communication with the fuel source (not shown) and the pressure detection means (not shown). It should be noted that in some embodiments, for example where the lance is not rotated continuously in one direction but is rotated alternately in opposite directions, a rotating union will not be required, and the fuel and pressure detection conduits may be connected via flexible hoses.

The above configuration describes but one embodiment of a lance arrangement that will be rotatable relative to the furnace vessel in which it is located, with many other configurations being foreseen.

In use, the lance 31 will be inserted into the vessel 11, and gas will be introduced into the upper end of the lance in order for the gas to be discharged from the lower end of the lance 32. Initially, the lance 31 will be displaced to a preparatory position or an initial operating position in which the end 32 of the lance is located above an upper surface of a molten material bath 13 inside the crucible, as a consequence the gas being discharged from the end of the lance 31 impinges on the upper surface of the molten material bath, thereby causing at least some operatively upwardly splashing of molten material from the molten bath 13. The lance 31 will be retained or lowered from the initial operating position whilst splashes of the molten material are deposited onto the outer walls of the lance. At the same time, the lance 31 will be caused to rotate in order for the molten material to be deposited evenly about a circumference of the lance, so as to form a protective coating and allow for uniform heating of the lance around its circumference. Once the coating has been formed, the lance 31 is submerged into the molten bath and process operation can commence. The swirl inducing device 46 provided in the flow passage 49 will cause the gas passing through the lance 31 to swirl and to be urged into contact with an inner surface of a sidewall of the lance so as to result in the fluid cooling the sidewall of the lance, thus effectively assisting to 'freeze' the coating layer.

It will be appreciated that the lance will be rotated not only prior to being submerged, but also whilst the lance is being submerged and during subsequent operation. The reason for this is that the lance is not only rotated to ensure that a uniform slag layer is formed on the lance, but also to ensure that the heating of the lance, with or without a slag layer, occurs symmetrically along the length and around the circumference of the lance. The formation of a uniform slag layer is a consequence of the uniform heating of the lance, which further assists with providing an ongoing benefit when operating the furnace. It is likely for the middle and upper part of the lance, which is where most of the lance bending occurs, not to be covered by a slag layer at all. Uniform heating of the lance in this region will, however, prevent lance bending from occurring, irrespective of the region being covered by a slag layer or not.

By rotating the lance during operation as in the above example, the heating of the lance occurs evenly both along the length and around the circumference of the lance. This uniform heating will eliminate or at least reduce lance bending, because it will prevent localized and unsymmetrical thermal stress in the lance body. In addition, in cases where a slag layer or coating is formed, the frozen slag layer that forms on, and adhere to, the lance's external surface is more likely to be symmetrical and even in thickness along the length and around the circumference of the lance, which will further prevent the occurrence of differential heating.

Figure 9:
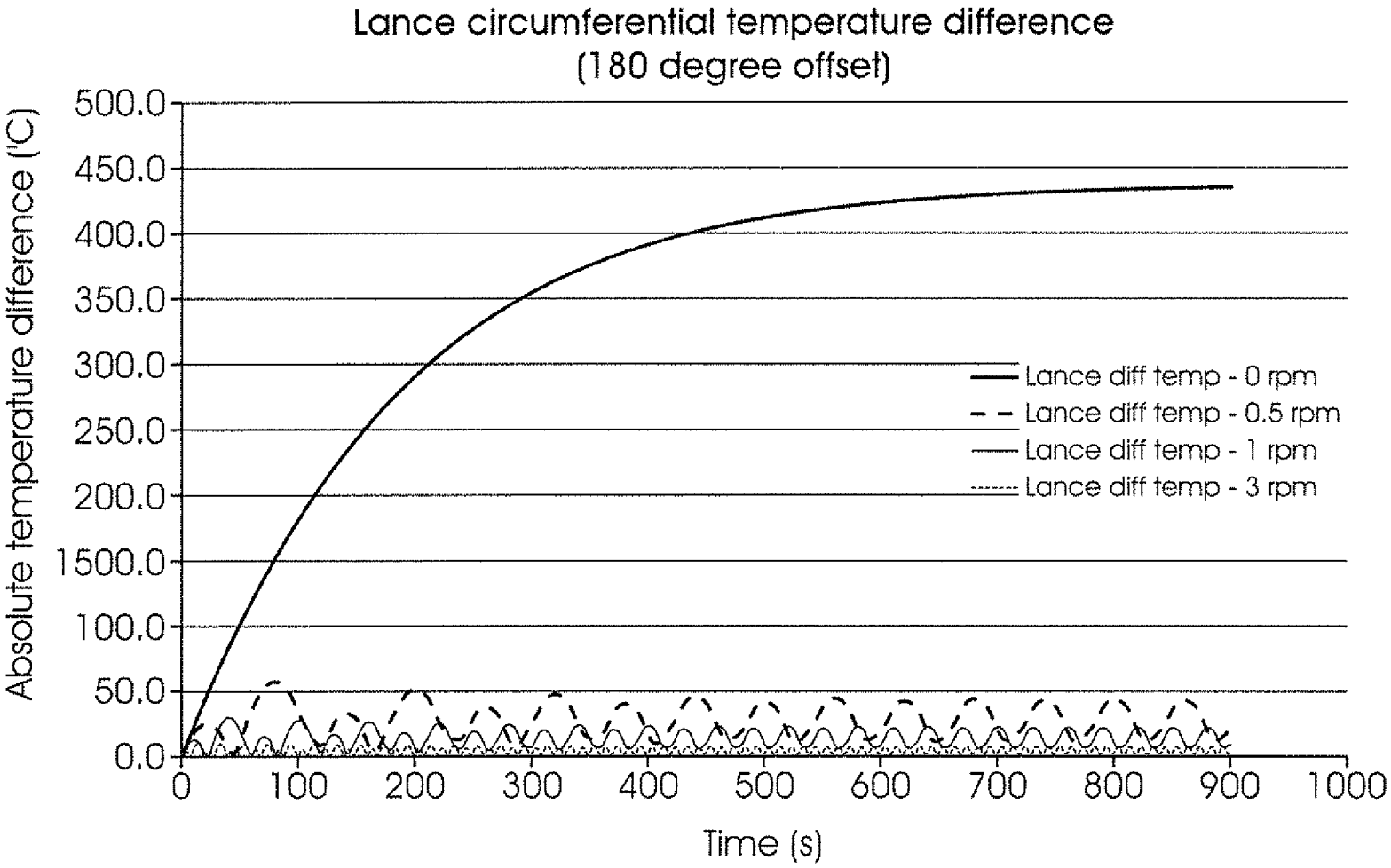
FIG. 9 is a graph showing the effect of lance rotation on differential lance temperature.

The effect of rotating the lance on the differential lance temperature is illustrated in FIG. 9. The graphical results are based on the assumption that at time zero the surrounding furnace space is at an even 800° C. It further assumes that due to either upset furnace conditions on one side of the lance, or due to the loss of the protective frozen slag layer on one side of the lance, the surrounding furnace space temperature increases to 1,300° C. on one side of the lance whilst remaining at 800° C. on the other side of the lance. As a result the differential temperature across the stationary lance is predicted to increase to above 400° C. within less than 10 minutes. In comparison, the differential temperature will be limited to less than 50° C. for a lance rotating at 0.5 rpm, less than 30° C. for a lance rotating at 1 rpm, and less than 10° C. for a lance rotating at 3 rpm.

In one example, the top submerged lance furnace is used to smelt copper chalcopyrite concentrate. In a typical scenario the feed rate of copper chalcopyrite concentrate is 150 t/h containing approximately 23.0% copper. The feed rate of silica flux is 3.1 t/h and limestone flux is 4.8 t/h. The feed rate of coal is 1.7 t/h. The molten bath is made up of a copper matte and a low copper iron-silicate slag which is located in the lower 2 meters of the furnace crucible height. The temperature of the bath is between 1160 and 1210° C. Diesel fuel is introduced at a rate of about 2,000 L/hr during initial operation and 200 L/hr during normal process operation. The lance oxygen flow rate is 6.8 $Nm^3/s$ and the air flow rate is 5.5 $Nm^3/s$ at an oxygen enrichment of 62%. The lance is rotated at about 3 RPM, and lance rotation is continued at this speed during process operation. In this example, the lance is heated more evenly compared to non-rotating lances found in conventional top submerged lance furnaces, which results in reduced bending of the lance.

Before the lance is submerged into the molten bath, the end of the lance will be held approximately 100 mm above the slag surface while the lance is being rotated. The lance is rotated at a speed of approximately 3 rpm, and process air is injected through the lance into the molten bath in order to allow slag to be deposited onto the end of the lance. A slag layer of between 1 and 20 mm is allowed to be formed, and after about 5 minutes the lance tip is inserted into the molten bath in order for normal operation to ensue. The lance penetrates about 300 mm into the molten bath, and the part of the lance in use protruding from the molten bath is then also continuously coated and uniformly heated while the lance is in operation.

It will be appreciated that the above is only one embodiment of the invention and that there may be many variations without departing from the spirit and/or the scope of the invention.

REFERENCES

[1]C. B. Solnordal, F. R. A. Jorgensen, and R. N. Taylor, "Modeling the Heat Flow to an Operating Sirosmelt Lance", Metall. Mater. Trans. B, 1998, Vol. 29B, pp. 485-492

[2]S. Gwynn-Jones, K. Hooman, B. Daniel, "Thermal Bending of Air Cooled Tubes" International Workshop on Thermal Forming and Welding Distortion, Bremen, Apr. 9-10, 2014

The invention claimed is:

1. A method of operating a top submerged lance furnace, the method including the steps of:

providing a lance having an internal flow passage provided therethrough, with an end of the lance located inside a crucible of a top submerged lance furnace;

causing the lance to rotate at a speed of between 0.5 and 6 rpm;

passing a fluid through the lance in order for the fluid to be discharged from the end of the lance;

displacing the lance to a preparatory position in which the end of the lance is located above an upper surface of a molten material bath in order for the fluid being discharged from the end of the lance to impinge on the upper surface of the molten material bath, thereby causing at least some operatively upwardly splashing of molten material;

holding the lance in the preparatory position in order for splashes of the molten material to be deposited onto an outer wall of the lance during the rotation; and submerging the end of the lance into the molten material bath inside the crucible.

2. The method of claim 1 including, in the preparatory position, the step of forming a protective coating about a circumference of the lance from the splashes of the molten material, the step being characterized in that molten material is deposited evenly about a circumference of the lance due to the lance being rotated.

3. The method of claim 1 including the step of imparting a swirling motion on the fluid passing through the lance from a swirl inducing device disposed in the lance in order for the fluid to be urged into contact with an inner surface of a sidewall of the lance, so as to result in the fluid cooling the sidewall of the lance.

4. The method of claim 1, wherein the rotational speed is maintained during process operation.

5. The method of claim 3, wherein the swirl inducing device comprises a helical baffle or an angular blade.

6. The method of claim 1, wherein the speed is between 1 and 3 rpm.

* * * * *